US005584780A

United States Patent [19]

Lin

[11] Patent Number: 5,584,780

[45] Date of Patent: Dec. 17, 1996

[54] WALKING EXERCISER

[75] Inventor: Chin T. Lin, Taichung Hsien, Taiwan

[73] Assignee: Hua Yeong Enterprise Co., Ltd., Ta Chia, Taiwan

[21] Appl. No.: 629,150

[22] Filed: Apr. 8, 1996

[51] Int. Cl.[6] ..... A63B 22/00

[52] U.S. Cl. ..... 482/51; 482/52

[58] Field of Search ..... 482/51, 52, 53, 482/79, 80, 70, 54, 130, 74, 129, 148; 434/255

[56] References Cited

U.S. PATENT DOCUMENTS

| | | | |
|---|---|---|---|
| 4,563,001 | 1/1986 | Terauds | 482/53 |
| 4,645,200 | 2/1987 | Hix | 482/79 |
| 4,850,585 | 7/1989 | Dalebout et al. | 482/70 |
| 4,861,023 | 8/1989 | Wedman | 482/51 |
| 4,940,233 | 7/1990 | Bull et al. | 482/52 |
| 4,989,858 | 2/1991 | Young et al. | 482/53 |
| 5,000,443 | 3/1991 | Dalebout et al. | 482/52 |
| 5,290,211 | 3/1994 | Stearns | 482/53 |
| 5,419,747 | 5/1995 | Piaget et al. | 482/51 |
| 5,496,235 | 3/1996 | Stevens | 482/51 |

*Primary Examiner*—Stephen R. Crow
*Attorney, Agent, or Firm*—Alfred Lei

[57] ABSTRACT

A walking exerciser including a folding collapsible base frame, two pedal frame bars having a respective pivot turned in a respective pivot hole on the base frame for pedaling by the user, two damping plates respectively mounted around the pivots and connected between pedal frame bars and the base frame to produce a damping resistance during the movement of the pedal frame bars, a front handlebar transversely mounted on the base frame at the front side, and two rear handlebars respectively connected to the pedal frame bars at the top.

2 Claims, 7 Drawing Sheets

WALKING EXERCISER

BACKGROUND OF THE INVENTION

1. Field of the Invention

This invention relates to exercising apparatus, and relates more particularly to a walking exerciser which comprises two pedal frame bars pivotably suspended from an upright base frame to hold two foot plates for pedaling.

2. Description of the Prior Art

A variety of exercising apparatus such as exer-hikers, rowing machines, stationary bicycles, etc. have been developed for exercising different parts of the body, and have appeared on the market. However, these exercising apparatus are commonly heavy, expensive, not collapsible, and not suitable for home use.

SUMMARY OF THE INVENTION

This invention is concerned with a walking exerciser which is practical in use for exercising walking. It is another object of the present invention to provide a walking exerciser which is inexpensive to manufacture. It is still another object of the present invention to provide a walking exerciser which can be conveniently adjusted to change its damping resistance to the desired level. It is still another object of the present invention to provide a walking exerciser which is collapsible. It is still another object of the present invention to provide a walking exerciser which needs little installation space.

According to one aspect of the present invention, the walking exerciser comprises a base frame, two pedal frame bars having a respective threaded pivot rod turned in a respective pivot hole on the base frame for pedaling by the user, two damping plates respectively mounted around the pivots and connected between pedal frame bars and the base frame to produce a damping resistance during the movement of the pedal frame bars, a front handlebar transversely mounted on the base frame at the front side, and two rear handlebars respectively connected to the pedal frame bars at the top. According to another aspect of the present invention, screw caps are respectively threaded onto the threaded pivot rods of the pedal frame bars to secure the pedal frame bars to the base frame and to control the damping resistance of the damping plates.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
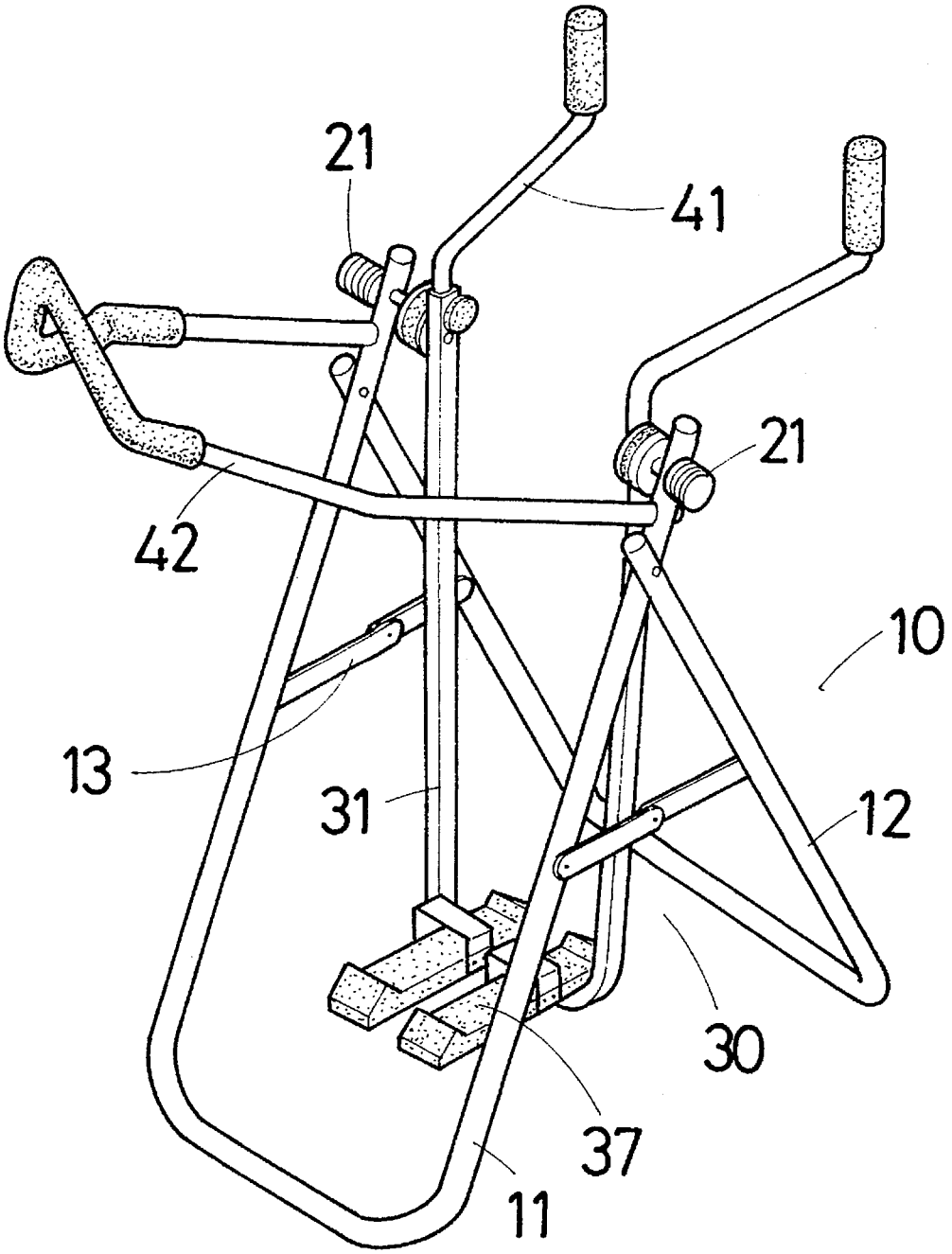
FIG. 1 is an elevational view of a walking exerciser according to the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
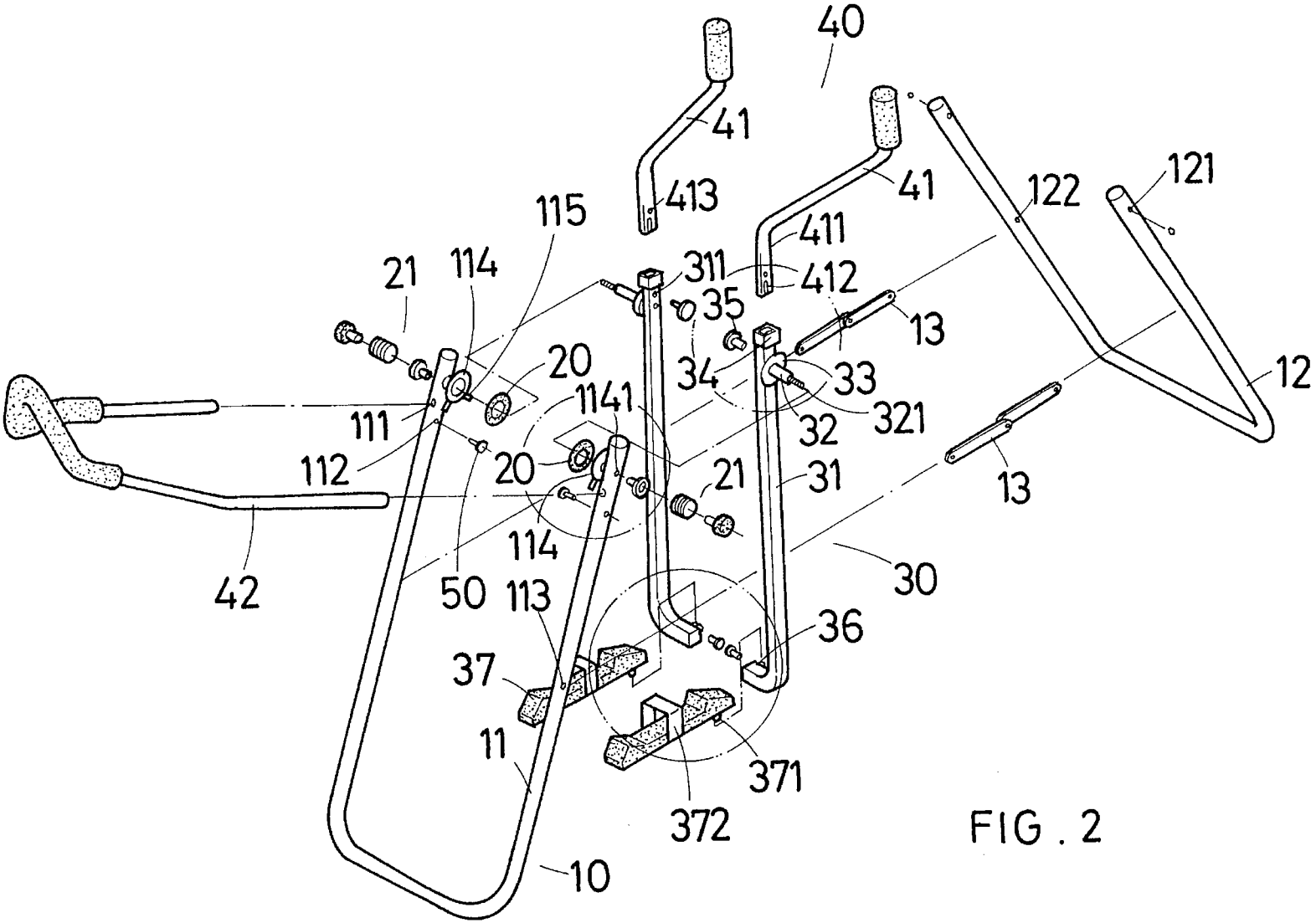
FIG. 2 is an exploded view of the walking exerciser shown in FIG. 1.

Referring to FIGS. 1 and 2, a walking exerciser in accordance with the present invention is generally comprised of a folding collapsible base frame 10, two damping plates 20 and two hollow shaft devices 21 respectively fastened to the base frame 10 at the top at two opposite sides, a pedal assembly 30 suspended from the base frame 10, and a handle unit 40 fastened to the base frame 10 at the top. The base frame 10 is comprised of a substantially U-shaped front frame tube 11, a substantially U-shaped rear frame tube 12 pivoted to the U-shaped front frame tube 11, and two folding links 13 bilaterally connected between the front frame tube 11 and the rear frame tube 12. The front frame tube 11 has two pivot holes 112 near two opposite ends thereof respectively connected to respective pivot holes 121 of the rear frame tube 12 by respective screws 50. Each of the folding links 13 has one end pivotably connected to one pivot hole 113 at the front frame tube 11, and an opposite end pivotably connected to a corresponding pivot hole 122 at the rear frame tube 12. The handle unit 40 comprises a pair of rear handlebars 41, and a front handlebar 42. The rear handlebars 41 are respectively shaped like a crank. The front handlebar 42 has a substantially U-shaped profile. The front handlebar 42 has a substantially U-shaped profile, two opposite ends respectively fastened to respective pug holes 111 at two opposite ends of the front frame tube 11 above the pivoted points between the front frame tube 11 and the rear frame tube 12.

Figure 3:
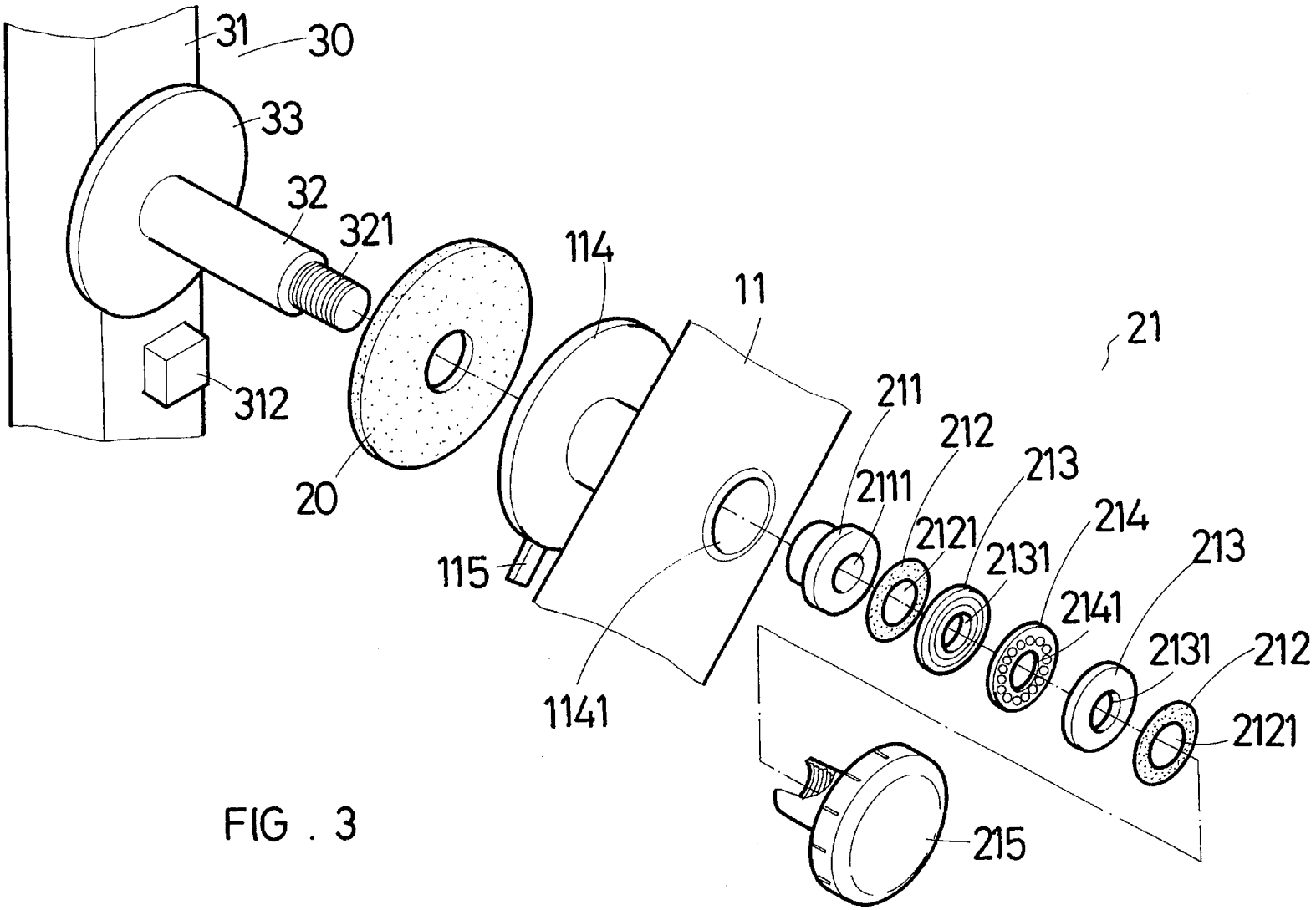
FIG. 3 is an enlarged view of a part of FIG. 2, showing the structure of the hollow shaft device and its position relative to the damping plate.
Figure 4:
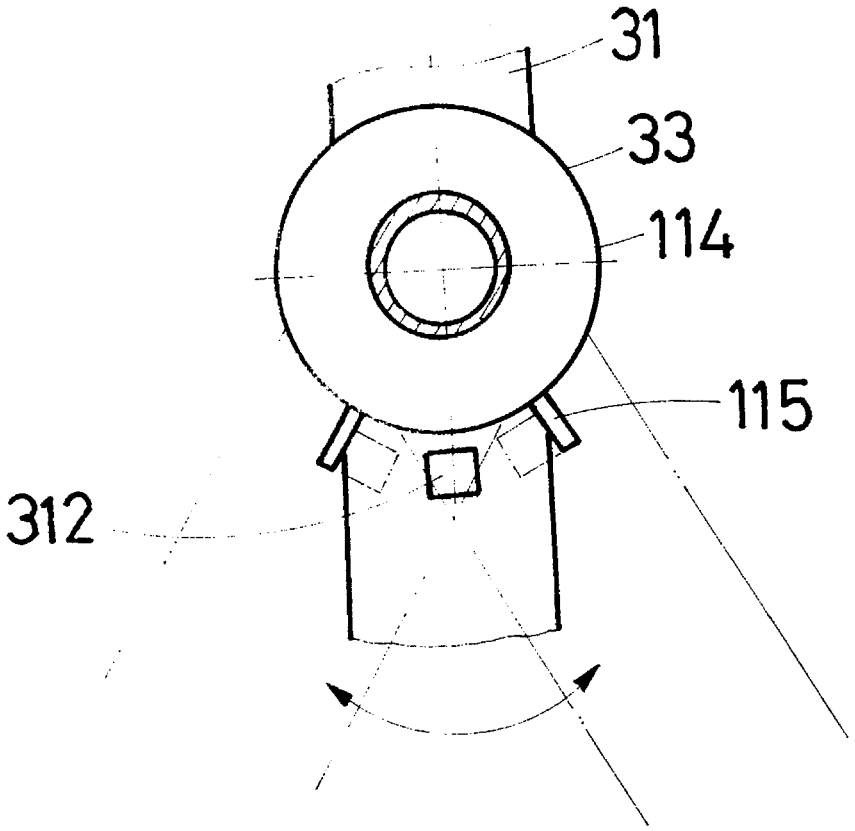
FIG. 4 is a schematic drawing showing the stop block of the pedal frame bar moved between the stop rods of the disk-like friction member according to the present invention.

Referring to FIGS. 3 and 4, and FIGS. 1 and 2 again, two disk-like friction members 114 are respectively fastened to the two opposite ends of the front frame tube 11. Each of the disk-like friction members 114 has a hollow center barrel 1141 fitted into one through hole (not shown) at one end of the front frame tube 11, and two stop rods 115 downwardly outwardly extending from the periphery and bilaterally spaced from the vertical line at 30. The pedal assembly 30 comprises two substantially L-shaped pedal frame bars 31. Each of the pedal frame bars 31 has transverse coupling rod 32 near the top, a circular friction plate 33 fixedly mounted around the coupling rod 32 outside the respective pedal frame bar 31, and a stop block 312 below the circular friction plate 33. The coupling rod 32 is inserted into the hollow center barrel 1141 of the disk-like friction member 114 at one end of the front frame tube 11, having a front end terminating in a screw rod 321. A screw cap 215 is threaded onto the screw rod 321 of the coupling rod 32 to hold one hollow shaft device 21 around the coupling rod 32 between one end of the front frame tube 11 and the screw cap 215. The damping plates 20 are respectively mounted around the coupling rod 32 of each pedal frame bar 31 and retained between the respective circular friction plate 33 and the respective disk-like friction member 114. Each of the hollow shaft devices 21 comprises a socket member 211 mounted around the respective coupling rod 32 and abutted against the end of the hollow center barrel 1141 of the respective disk-like friction member 114, two washers 212 mounted around the respective coupling rod 32 between the socket member 211 and the respective screw cap 215, two bearing shells 213 mounted around the respective coupling rod 32 and retained between the washers 212, and a ball bearing 214 mounted around the respective coupling rod 32 and retained between the bearing shells 213. The socket member 211, the washers 212, the bearing shells 213, and the ball bearing 214 have a respective center through hole 2111, 2121, 2131, 2141 for the passing of the respective coupling rod 32. When assembled, the stop rods 115 of the disk-like friction member 114 are disposed at two sides relative to the stop block 312 of the respective pedal frame bar 31. The stop block 312 limits the turning angle of the pedal frame bar 31 relative to the front frame tube 11.

Figure 5:
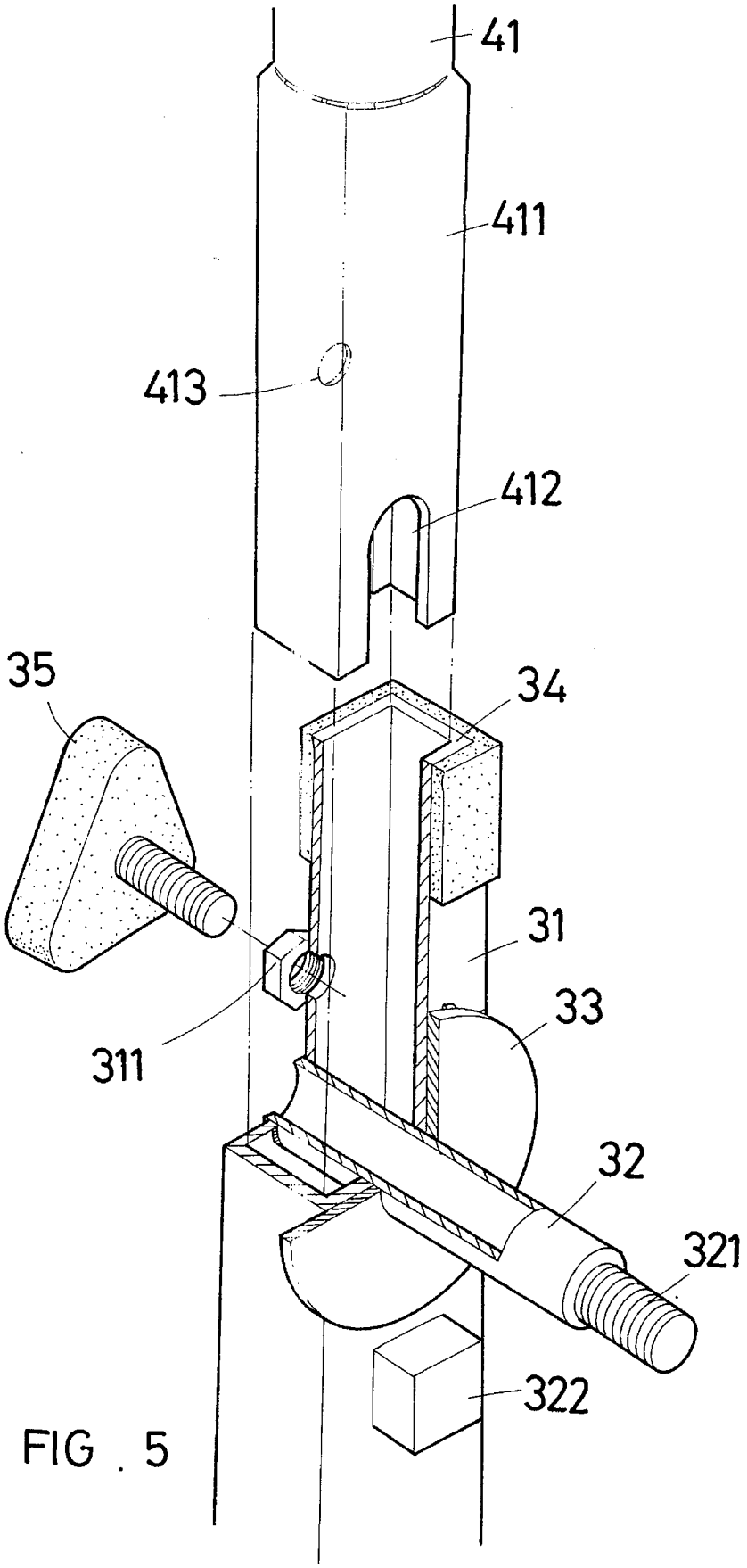
FIG. 5 is an enlarged view of a part of FIG. 2, showing the structure of the upper part of the pedal frame bar and the positioning of the rear handlebar.
Figure 6A:
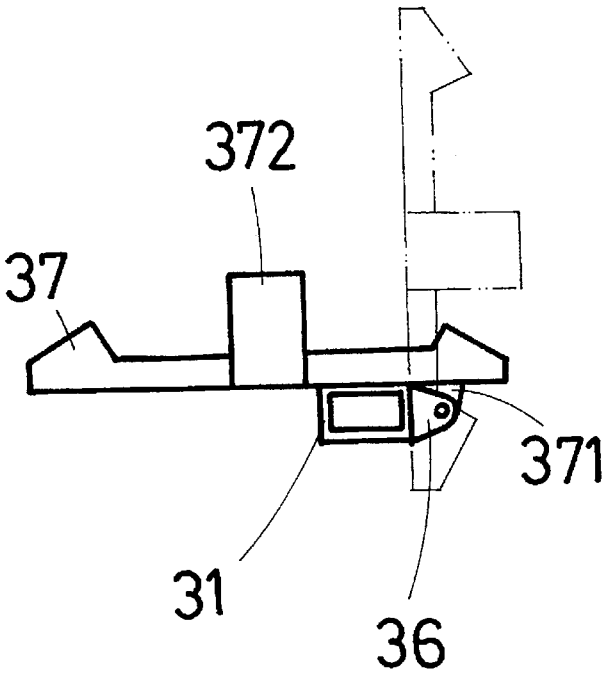
FIG. 6A shows the operation of the foot plate connected to the pedal frame bar.
Figure 6B:
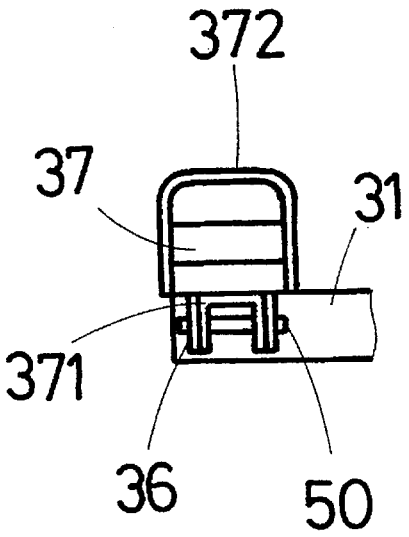
FIG. 6B is an end elevational view of FIG. 6A.

Referring to FIGS. 5, 6A and 6B, and FIGS. 1 and 2 again, each of the L-shaped pedal frame bars 31 has a top coupling hole 34, which receives one rear handlebar 41, and a fixed nut 311 fixedly secured thereto at one side near the top opposing to the respective circular friction plate 33. A lock screw 35 is threaded into the fixed nut 311 to hold one rear handlebar 41. Each of the rear handlebars 41 has a bottom coupling section 411 fitted into the top coupling hole 34 of one pedal frame bar 31 and fixed in place by the lock screw 35 of the respective pedal frame bar 31. The bottom coupling section 411 has a locating hole 413 at one side which receives the lock screw 35 of the respective pedal frame bar 31, and an arched bottom notch 412 which is forced into engagement with the coupling rod 32 of the respective pedal frame bar 31. The opposite (top) end of each of the rear handlebars 41 is preferably covered with a soft covering for the holding of the hand. The bottom end of each of the pedal frame bar 31 is fixedly mounted with a substantially U-shaped mounting plate 36 to hold a respective foot plate 37. The foot plate 37 has a substantially U-shaped mounting plate 371 at the bottom fixedly secured to the U-shaped mounting plate 36 of one pedal frame bar 31 by screws 50, and a toe-strap 372 at the top.

Referring to FIGS. 1 through 6A and 6B again, when assembled, the damping plates 20 are respectively mounted around the respective coupling rods 32 and retained between the respective circular friction plates 33 and the respective disk-like friction members 114. When the pedal frame bars 31 of the pedal assembly 30 are turned relative to front frame tube 11 of the base frame 10, the damping plates 20 are forced to rub against the respective disk-like friction members 114, and therefore a damping resistance is produced against the movement of the pedal frame bars 31. During the movement of the pedal frame bars 31, the screw caps 215 are synchronously turned with the screw rods 321, the socket members 211 are immovable and firmly stopped against the hollow center barrels 1141 of the respective disk-like friction members 114, and the ball bearings 213 are freely turned to offset the reaction force transmitted from the socket members 211. Therefore, the screw caps 215 do not disconnect from the respective screw rods 321 during the pedaling of the pedal assembly 30. As the pedal frame bars 31 are alternatively pedaled, the stop block 312 of each pedal frame bar 31 is alternatively stopped at the stop rods 115 of the disk-like friction members 114 of the front frame tube 11 (see FIG. 4), therefore the turning angle of each pedal frame bar 31 is limited within a safety range. Furthermore, by turning the screw caps 215 inwards or outwards, the damping resistance is relatively adjusted. When not in use, the folding links 13 of the base frame 10 are folded up to collapse the front frame tube 11 and the rear frame tube 12. The rear handlebars 41 can be conveniently disconnected from the pedal frame bars 31 by loosening the lock screws 35.

Figure 8:
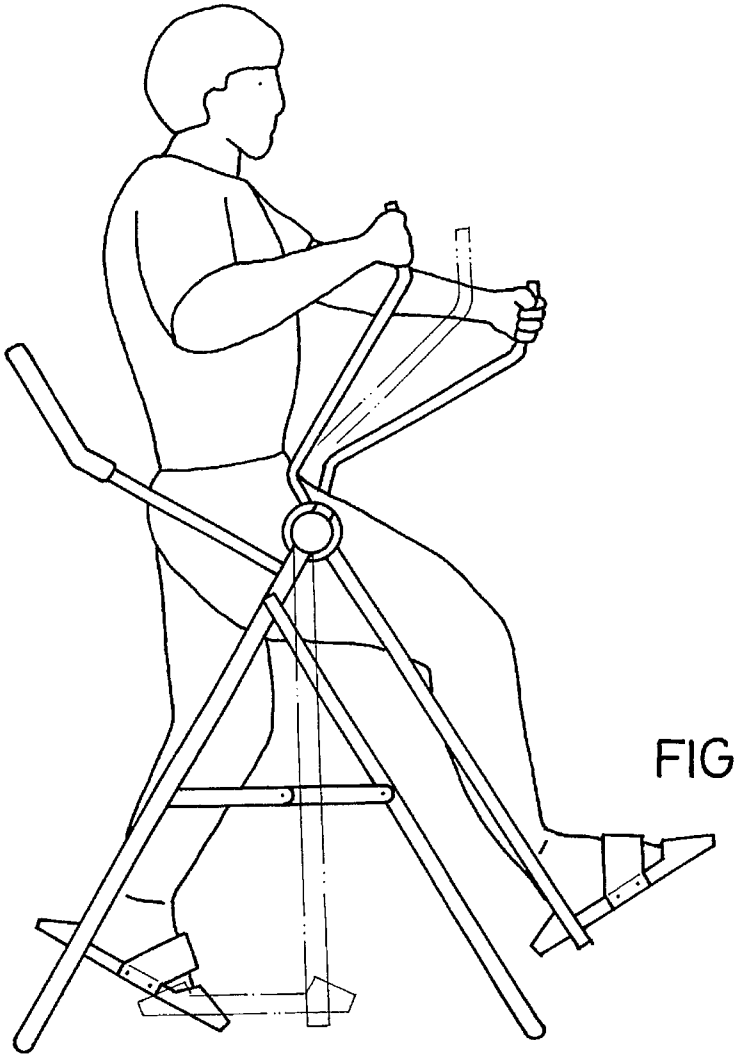
FIG. 8 shows another exercising example of the present invention.
Figure 7:
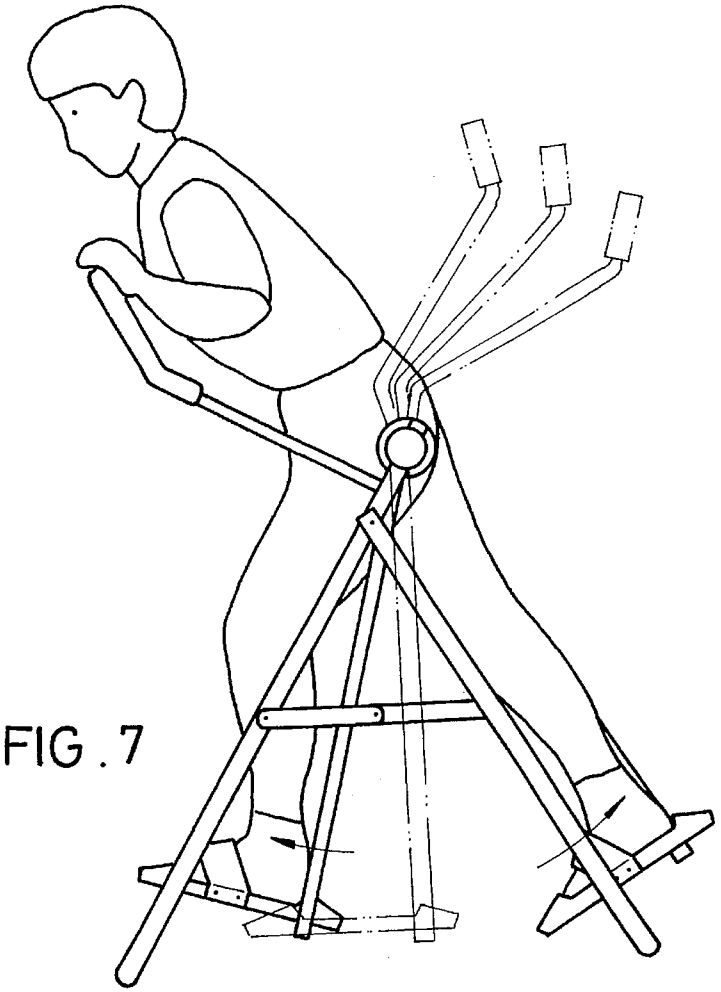
FIG. 7 shows one exercising example of the present invention.

Referring to FIGS. 7 and 8, when in use, the user stands on the foot plates 37 with the hands holding the front handlebar 42 (see FIG. 7) or the rear handlebars 41 (see FIG. 8). When moving the foot plates 37 with the legs alternatively, the pedal frame bars 31 are alternatively turned up and down relative to the front frame tube 11, and the damping plates 20 give a damping resistance to the pedal frame bars 31. By turning the screw caps 215, the damping resistance of the damping plates 20 can be adjusted to the desired level. Because the turning angle of the pedal frame bars 31 is constrained within a limited range by the stop rods 115, no accident will happen during exercising. Furthermore, when not in use, the whole assembly can be collapsed.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A walking exerciser comprising:

a base frame, said base frame comprising a substantially U-shaped front frame tube having two upward opposite ends, a substantially U-shaped rear frame tube having two upward opposite ends respectively pivoted to the two opposite ends of said front frame tube, and two folding links bilaterally connected between said front frame tube and said rear frame tube, said front frame tube having two disk-like friction members respectively fixed to the two opposite ends, each of said disk-like friction members having two stop rods extending from the periphery;

two substantially L-shaped pedal frame bars respectively pivoted to the two opposite ends of said front frame tube for pedaling, each of said pedal frame bars having a coupling rod turned in a respective pivot hole at one end of said front frame tube and terminating in a screw rod, a circular friction plate fixedly mounted around said coupling rod, and a stop block below said circular friction plate, said stop block being moved with the respective pedal frame bar between the stop rods of the disk-like friction member at one end of said front frame tube;

two damping plates respectively mounted around the coupling rods of said pedal frame bars and retained between the circular friction plates of said pedal frame bars and the disk-like friction members of said front frame tube;

two hollow shaft devices respectively mounted around the coupling rods of said pedal frame bars and secured thereto by a respective screw cap, said screw cap being threaded onto the screw rod of the respective coupling rod, each of said hollow shaft devices comprising a socket member mounted around the respective coupling rod and abutted against one end of said front frame tube, two washers mounted around the respective coupling rod between said socket member and the respective screw cap, two bearing shells mounted around the respective coupling rod and retained between said washers, and a ball bearing mounted around the respective coupling rod and retained between said bearing shells;

a front handlebar having two opposite ends respectively connected to the two opposite ends of said front frame tube, and a middle part curving upwards and covered with a rubber covering for the holding of the hand; and two rear handlebars respectively connected to said pedal frame bars at the top.

2. The walking exerciser as claimed in claim 1 further comprising two foot plates respectively fastened to said pedal frame bars at the bottom.

* * * * *